US009464462B1

(12) United States Patent
Liu

(10) Patent No.: US 9,464,462 B1
(45) Date of Patent: Oct. 11, 2016

(54) PADLOCK WITH NON-CONDUCTIVE PARTS

(71) Applicant: FEDERAL LOCK CO., LTD., Pingtung County (TW)

(72) Inventor: Tien-Kao Liu, Pingtung County (TW)

(73) Assignee: Federal Lock Co., Ltd., Pingtung County (TW)

( * ) Notice: Subject to any disclaimer, the term of this patent is extended or adjusted under 35 U.S.C. 154(b) by 0 days.

(21) Appl. No.: 14/928,022

(22) Filed: Oct. 30, 2015

(51) Int. Cl.
*E05B 67/02* (2006.01)
*E05B 67/24* (2006.01)

(52) U.S. Cl.
CPC ..... *E05B 67/02* (2013.01); *E05B 67/24* (2013.01)

(58) Field of Classification Search
CPC ..... E05B 67/24; E05B 67/02; E05B 67/04; E05B 67/063; E05B 67/22; E05B 67/365; E05B 67/38; Y10T 70/491; Y10T 70/7638; Y10T 70/7751
USPC .... 70/38 R, 38 A–38 C, 39, 42, 43, 53, 371, 70/386
See application file for complete search history.

(56) References Cited

U.S. PATENT DOCUMENTS 2,199,336 A * 4/1940 Fletcher ..... E05B 67/24 70/371
2,457,650 A * 12/1948 Dyson ..... E05B 67/24 70/369
2,489,484 A * 11/1949 Dyson ..... E05B 67/24 70/370
3,172,279 A * 3/1965 Patriquin ..... E05B 67/24 70/38 A
3,254,516 A * 6/1966 Tornoe ..... E05B 67/24 70/370
4,763,496 A * 8/1988 Evans ..... E05B 67/24 70/368
4,776,187 A * 10/1988 Evans ..... E05B 67/24 70/369
5,755,121 A * 5/1998 Crass ..... E05B 11/00 70/38 A
5,896,761 A * 4/1999 Chen ..... E05B 9/084 70/367
5,931,030 A * 8/1999 Chen ..... E05B 9/084 70/371
6,101,852 A * 8/2000 Steinbach ..... E05B 67/06 70/38 A
6,766,673 B2 * 7/2004 Gast ..... E05B 67/06 70/26
8,245,547 B1 * 8/2012 Garthe ..... E05B 67/24 70/367
8,820,125 B1 * 9/2014 Dolev ..... E05B 67/02 70/38 A
9,297,185 B2 * 3/2016 Lasaroff ..... E05B 67/02
2004/0194516 A1 * 10/2004 Chen ..... E05B 21/066 70/54
2006/0185404 A1 * 8/2006 Hansen ..... E05B 9/084 70/38 A
2007/0107476 A1 * 5/2007 Ruan ..... E05B 67/02 70/38 A
2011/0094273 A1 * 4/2011 Uliano ..... E05B 67/24 70/53
2013/0276487 A1 * 10/2013 Burmesch ..... E05B 67/18 70/42

FOREIGN PATENT DOCUMENTS

GB 2224071 A * 4/1990 ..... E05B 67/24

* cited by examiner

*Primary Examiner* — Suzanne Barrett
(74) *Attorney, Agent, or Firm* — Rosenberg, Klein & Lee

(57) ABSTRACT

A padlock includes a body having a first recess in the top thereof. A slide slot is defined in one side of the body and communicates with the first recess. A slide is located in the slide slot and movable between a locked position and an unlocked position. The slide protrudes beyond the body when the slide is located at the locked position, and is retracted into the body when the slide is located at the unlocked position. A housing is mounted to the body and has a first hole defined in the inside thereof. Two second holes are defined in the top of the housing. The slide is located in the first hole when the slide is located at the locked position. The slide can be moved and separated from the housing to replace the shackle and the cylinder when the padlock is unlocked.

8 Claims, 12 Drawing Sheets

PADLOCK WITH NON-CONDUCTIVE PARTS

BACKGROUND OF THE INVENTION

1. Fields of the Invention

The present invention relates to a padlock, and more particularly, to a padlock with replaceable shackle and cylinder. The padlock has non-conductive feature so as to be used with electrical equipment to ensure safety of the maintainers.

2. Descriptions of Related Art

The conventional padlocks are widely used locks and some of them have replaceable shackle and cylinder so that theses padlocks can be used with different types of equipment or objects without purchasing whole new locks to save the cost. By replaceable shackles and cylinder, the unauthorized persons difficult to guess the correct key. Alternatively, the cylinders of multiple locks can be set to have the same structure so that the users do not need to carry different keys.

In order to keep the maintainers safety when maintaining electrical equipment, many countries have set as a law to require a lock is necessary for the electric equipment such as the power boxes so as to prevent unauthorized access and operation. Because the electric equipment have potential risk of electric shocking which can seriously injure the maintainers when opening or locking the power boxes, so that the locks used to the electric equipment have to be non-conductive.

U.S. Pat. No. 5,755,121 discloses a lock body having opposing identical molded plastic sections which are composed of a first part and a second part. Each of the first and second pars has an inside, an outside and an upright wall that is attached to the inside and ends at the two sides of the inside. The first and second parts are connected to each other by connecting integral pins to holes. The first and second parts may also be connected to each other by way of ultra-sonic welding. A room is defined between the first and second parts when the sides of the first and second parts are connected to each other. However, the connection by the pins and holes is easily damaged because the lock is made by plastic material. If the connection is made by way of ultra-sonic welding, then the lock cannot be dis-assembled, so that it is impossible to replace the cylinder or shackle, and this does not meet the requirements in the market. If the lock should be replaced, then a whole new lock has to be purchased and this increases the cost.

The present invention intends to provide a padlock to eliminate the shortcomings mentioned above.

SUMMARY OF THE INVENTION

The present invention relates to a padlock and comprises a body having a first recess defined in the top thereof. A slide slot is defined in one side of the body and communicates with the first recess. A slide is located in the slide slot and movable between a locked position and an unlocked position. The slide protrudes beyond the body when the slide is located at the locked position, and the slide is retracted into the body when the slide is located at the unlocked position. A housing is mounted to the body and has a first hole defined in the inside thereof. Two second holes are defined in the top of the housing. The slide is located in the first hole when the slide is located at the locked position.

Preferably, the slide has a through hole facing the first recess. A positioning member is engaged with the through hole and positions the slide when the slide is located at the locked position. The positioning member is removed from the through hole and releases the slide when the slide is located at the unlocked position.

Preferably, the positioning member has a protrusion extending laterally therefrom. The shape of the through hole is correspondent to the shape of the positioning member and the shape of the protrusion. The protrusion is engaged with the slide when the slide is located at the locked position.

Preferably, the slide has a receiving recess defined in the outside thereof. When the slide is located at the locked position, the positioning member is rotated and the protrusion is received in the receiving recess.

Preferably, the slide has a recessed portion which is located corresponding to the lower end of first recess. The recessed portion communicates with the through hole. A dent is defined in the inside of the recessed portion and located corresponding to the positioning member. When the slide is located at the locked position, the positioning member is rotated and the protrusion is located in the recessed portion.

Preferably, the slide slot has a receiving hole communicating with the first recess. A resilient member is received in the receiving hole and biased between the inner end of the receiving hole and the lower end of the positioning member. The resilient member is compressed. A slot is defined in the top end of the positioning member.

Preferably, the body, the slide and the housing are made from insulation material.

Preferably, the body has a second recess, a room and a reception hole. The second recess is located at one end of the first recess. The depth of the second recess is deeper than that of the first recess. The reception hole axially communicates with the room and transversely communicates between the first and second recesses. A conjunction portion between the reception hole and the first recess is located above the slide slot. A groove is defined in the inside of the top of the body and communicates with the second recess. An opening is defined in the underside of the body.

Preferably, the second recess and the room are defined from one side of the body. A cover is connected to the side of the body. The second recess and the room are defined between the body and the cover.

Preferably, the body has at least one connection hole. The cover has a passage which is located corresponding to the at least one connection hole. A fixing member extends through passage and the at least one connection hole to fix the cover to the body. A cylinder is received in the room and has a keyhole which is located at the opening. The cylinder drives a cam located in the reception hole, and the cam has two recessed areas. Two securing members are respectively located at the conjunction portion between the reception hole and the first recess, and a conjunction portion between the reception hole and the second recess. The two securing members are received in the two recessed areas when the cam is rotated. A shackle has a first leg and a second leg which is shorter than the first leg. The first leg extends through one of the two second holes and is inserted into the second recess. The first leg has a head at the distal end thereof. The groove has an engaging member located corresponding to the head. The housing has a positioning block to positioning the engaging member. Each of the first and second legs has a notch. The second leg extends into the other one of the two second holes and is located in the first recess to impede a conjunction portion between the slide slot and the first recess when the slide is located at the locked position. The cam is rotated to engage the securing members with the notches. When the slide is located at the unlocked position, the second leg is separated from the first recess.

The primary object of the present invention is to provide a padlock wherein when the padlock is unlocked, the second leg is separated from the first recess so that the user can use a tool to rotate and press the positioning member, such that the positioning member is rotated to engage the protrusion with the recessed portion. The slide is moved and completely inserted into the slide slot of the body, such that the body can be removed from the housing to replace the cylinder and the shackle. When the cylinder and the shackle are replaced, the body is then put into the housing. The tool is used to rotate the positioning member, and the resilient member push the protrusion toward the receiving recess, and the positioning member is rotated to engage the protrusion with the receiving recess. The slide is then positioned and installed to the first hole to complete the assembly of the padlock. The padlock is easily assembled and disassembled. The replaceable cylinder and shackle ensure the safety of the padlock.

Another object of the present invention is to provide a padlock wherein the body, the slide and the housing are made from insulation material, so that the padlock is suitable for being used with electric equipment to prevent the maintainers from being injured by electric shocking.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
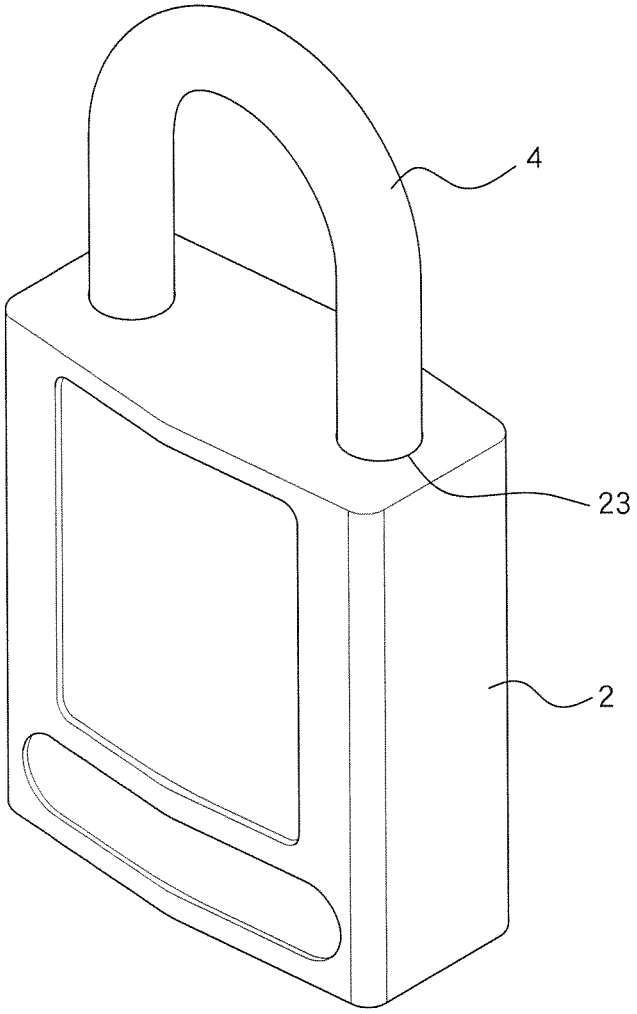
FIG. 1 is a perspective view to show the padlock of the present invention.
Figure 2:
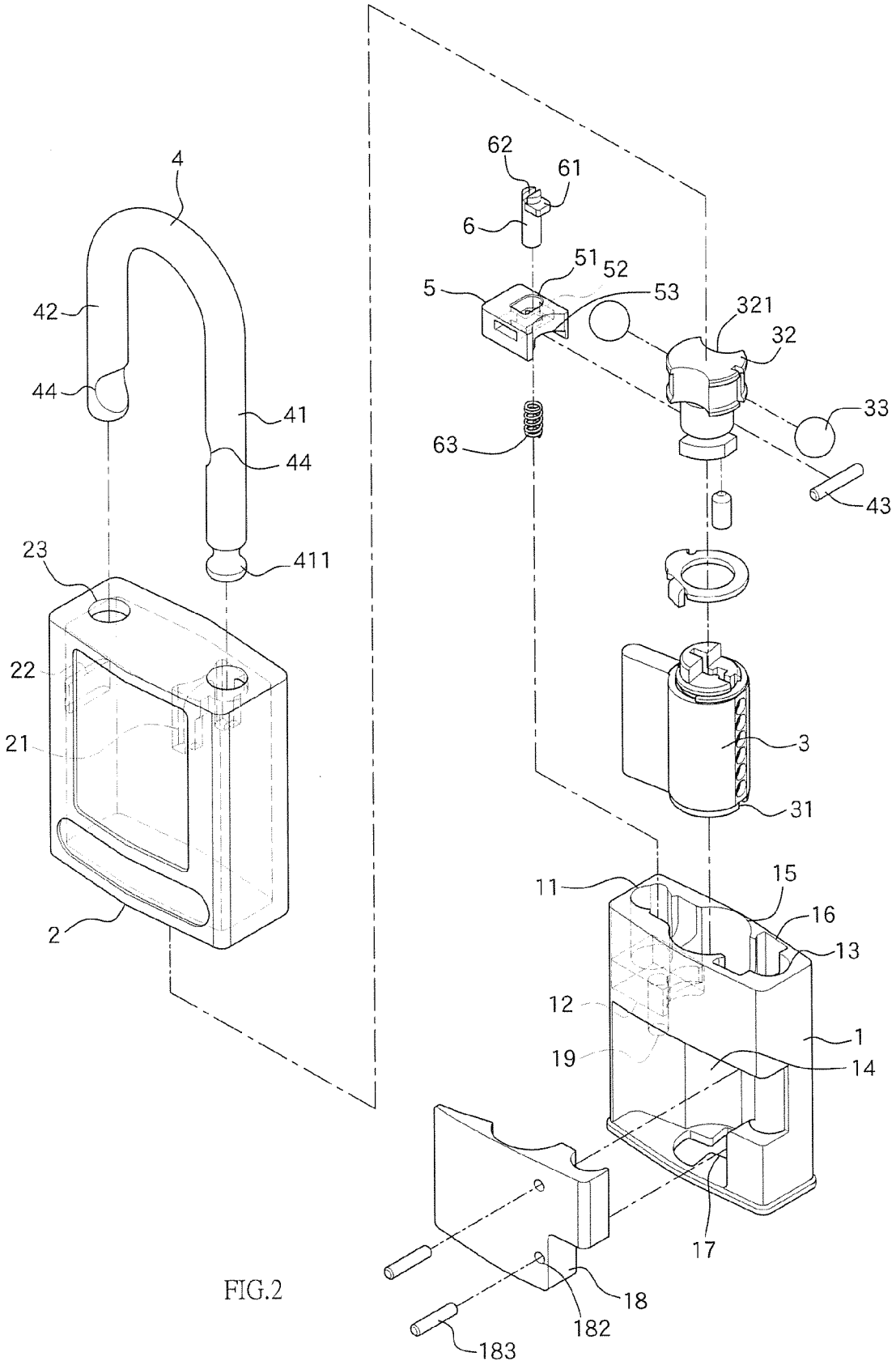
FIG. 2 is an exploded view of the padlock of the present invention.
Figure 3:
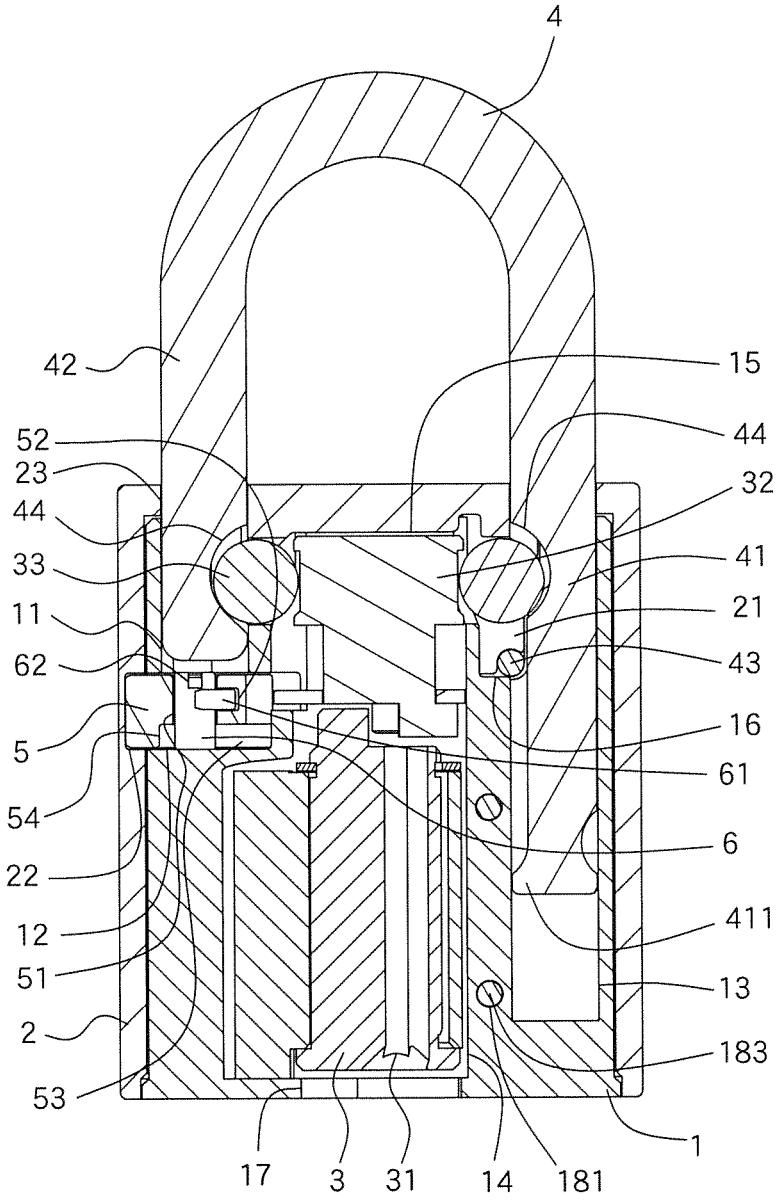
FIG. 3 is a cross sectional view the padlock of the present invention when the padlock of the present invention is locked.

Referring to FIGS. 1 to 3, the padlock of the present invention comprises a body 1 having a first recess 11 defined in the top thereof. A slide slot 12 is defined in one side of the body 1 and communicates with the first recess 11. The body 1 has a second recess 13, a room 14 and a reception hole 15. The second recess 13 is located at one end of the first recess 11. The depth of the second recess 13 is deeper than that of the first recess 11. The reception hole 15 axially communicates with the room 14 and transversely communicates between the first and second recesses 11, 13. A conjunction portion between the reception hole 15 and the first recess 11 is located above the slide slot 12. A groove 16 is defined in the inside of the top of the body 1 and communicates with the second recess 13. An opening 17 is defined in the underside of the body 1.

A housing 2 is mounted to the body 1 and has a first hole 22 defined in the inside thereof. Two second holes 23 are defined in the top of the housing 1.

In one embodiment, the second recess 13 and the room 14 are defined from one side of the body 1. A cover 18 is connected to the side of the body 1, so that the second recess 13 and the room 14 are defined between the body 1 and the cover 18. The body 1 has at least one connection hole 181. The cover 18 has a passage 182 which is located corresponding to the at least one connection hole 181. A fixing member 183 extends through passage 182 and the at least one connection hole 181 to fix the cover 18 to the body 1.

A cylinder 3 is received in the room 14 and has a keyhole 31 which is located at the opening 17, the cylinder 3 drives a cam 32 located in the reception hole 15, the cam 32 has two recessed areas 321, two securing members 33 are respectively located at the conjunction portion between the reception hole 15 and the first recess 11, and the conjunction portion between the reception hole 15 and the second recess 13.

A shackle 4 has a first leg 41 and a second leg 42 which is shorter than the first leg 41. The first leg 41 extends through one of the two second holes 23 and is inserted into the second recess 13. The first leg 41 has a head 411 at the distal end thereof. The groove 16 has an engaging member 43 located corresponding to the head 411. The housing 2 has a positioning block 21 to positioning the engaging member 43. Each of the first and second legs 41, 42 has a notch 44.

Figure 4:
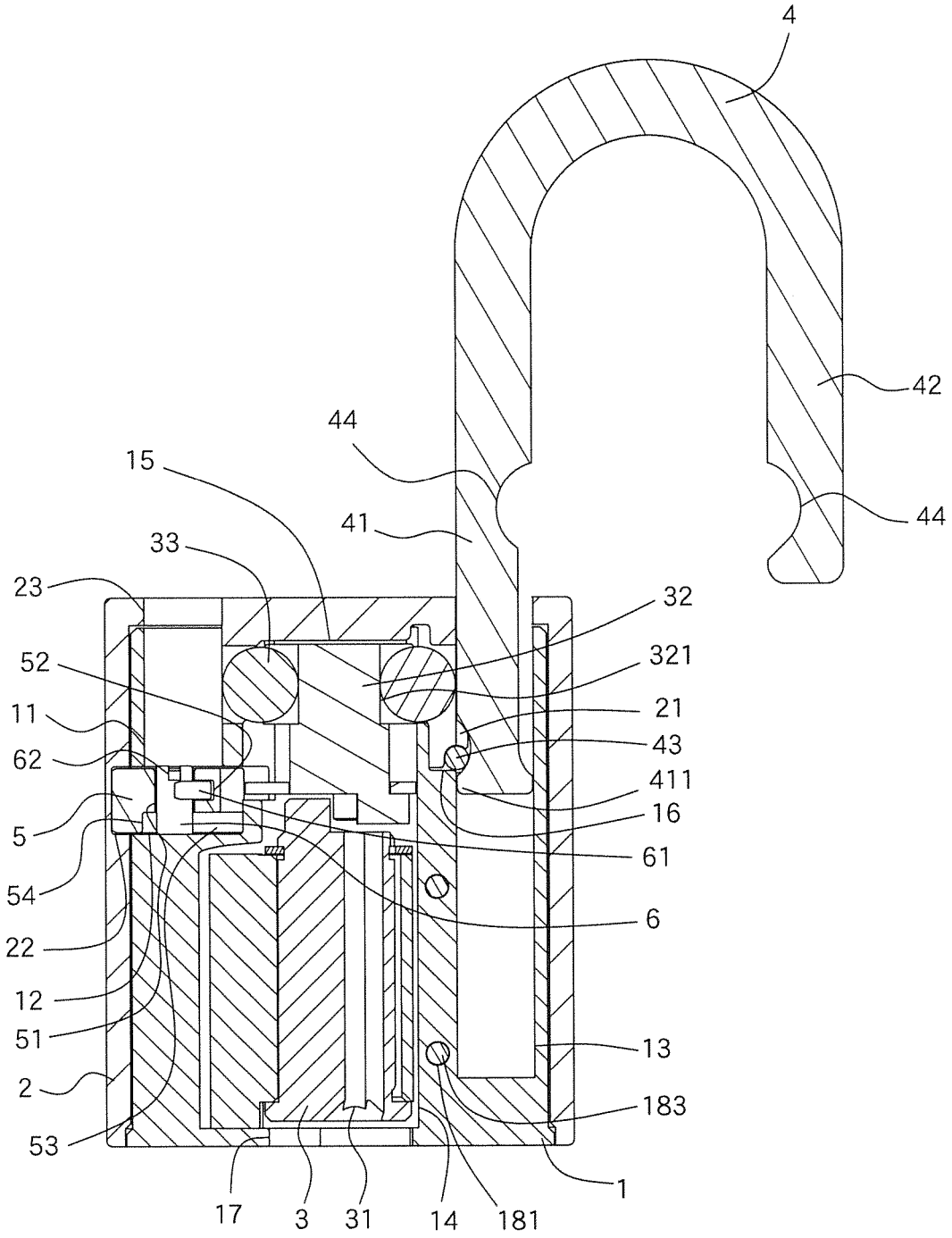
FIG. 4 is a cross sectional view of the padlock of the present invention when the padlock of the present invention is unlocked.

When the padlock is locked, as shown in FIG. 3, the second leg 42 extends into the other one of the two second holes 23 and is located in the first recess 11 to impede a conjunction portion between the slide slot 12 and the first recess 11. By rotating the cylinder 3, the cam 32 is rotated to engage the securing members 33 with the notches 44. When the padlock is unlocked, as shown in FIG. 4, a key (not shown) is used to rotate the cylinder 3 to rotate the cam 32, the recessed areas 321 of the cam 32 face the conjunction portion between the reception hole 15 and the first recess 11, and the conjunction portion between the reception hole 15 and the second recess 13. The securing members 33 are removed from the notches 44 and enter into the recessed areas 321. Therefore, the second leg 42 can be removed from the first recess 11. The head 411 of the first leg 41 is engaged with the positioning block 21 and the engaging member 43, so that the first leg 41 cannot completely removed from the second recess 13.

Figure 5:
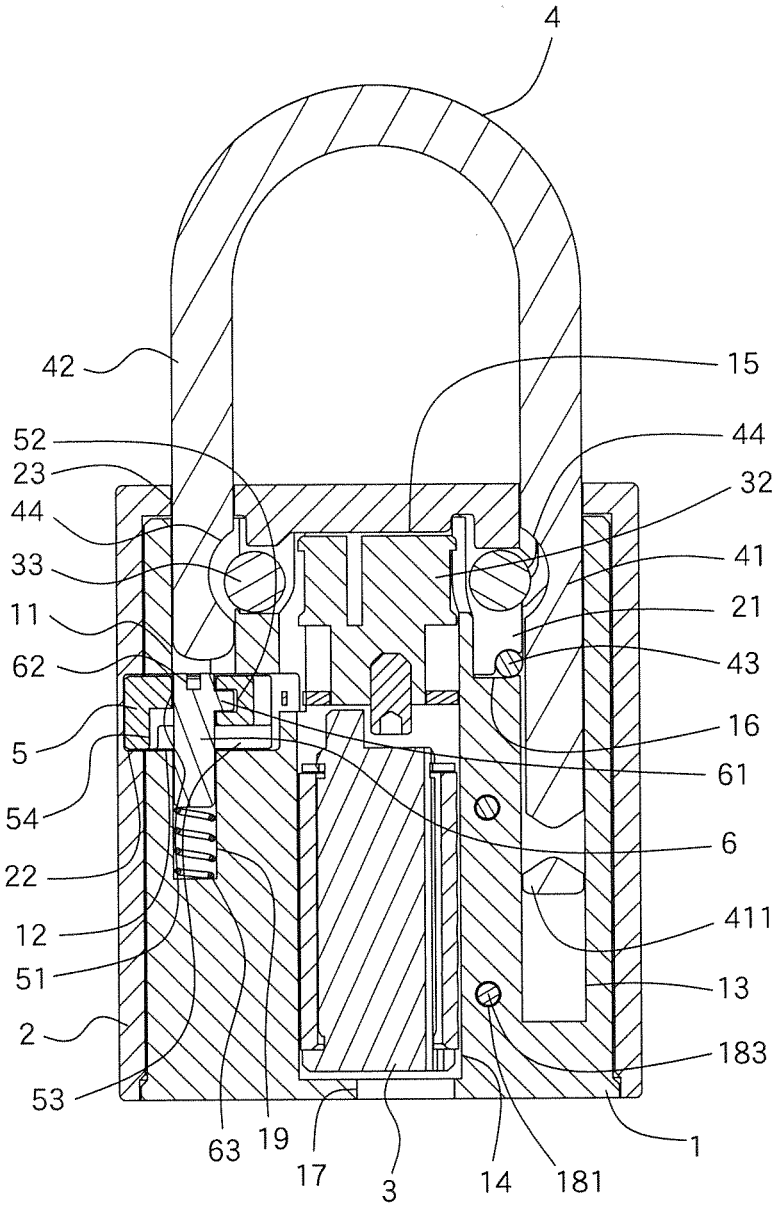
FIG. 5 is a cross sectional view of the padlock of the present invention to show at the receiving hole when the padlock of the present invention is locked.
Figure 6:
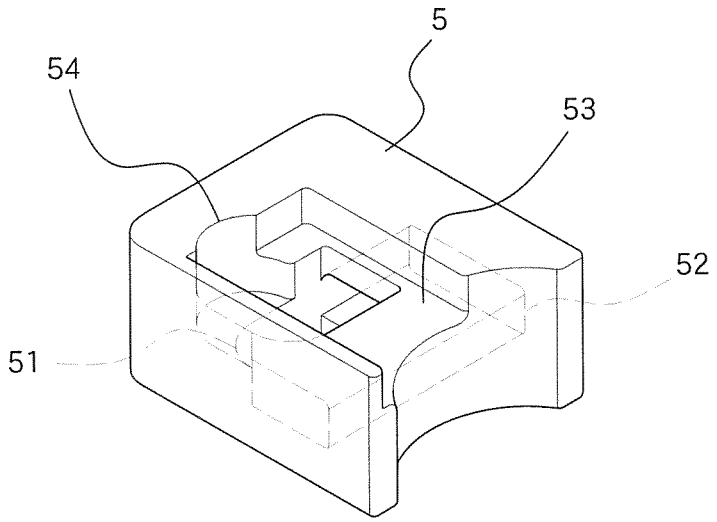
FIG. 6 is a perspective view of the slide of the padlock of the present invention.

As shown in FIG. 5, for the positioning of the body 1 and the housing 2, the body 1 has a slide 5 as shown in FIGS. 2, 5 and 6, the slide 5 is located in the slide slot 12 and movable between a locked position and an unlocked position. The slide 5 protrudes beyond the body 1 when the slide 5 is located at the locked position. The slide 5 located in the first hole 22 when the slide 5 is located at the locked position.

The slide 5 is retracted into the body 1 when the slide 5 is located at the unlocked position.

In one embodiment, the slide 5 has a through hole 51 facing the first recess 11. A positioning member 6 is engaged with the through hole 51 and positions the slide 5 when the slide 5 is located at the locked position. the positioning member 6 has a protrusion 61 extending laterally therefrom. The shape of the through hole 51 is correspondent to the shape of the positioning member 6 and the shape of the protrusion 61. The slide 5 has a receiving recess 52 defined in the outside thereof. The slide 5 has a recessed portion 53 which is located corresponding to the lower end of first recess 11. The recessed portion 53 communicates with the through hole 51. A dent 54 is defined in the inside of the recessed portion 53 and located corresponding to the positioning member 6.

As shown in FIG. 5, when padlock is locked, the positioning member 6 is rotated and the protrusion 61 is received in the receiving recess 52, not at the through hole 51. The protrusion 61 is engaged with the slide 5 so that the positioning member 6 is engaged with the through hole 51 so that the slide 5 protrudes from the body 1 and cannot be moved. The body 1 is connected to the first hole 22 of the housing 2 by the slide 5 to securely connect the body 1 and the housing 2. Even if the padlock is hit, because the slide 5 is positioned by the positioning member 6, the slide 5 cannot be removed from the housing 2.

Figure 7:
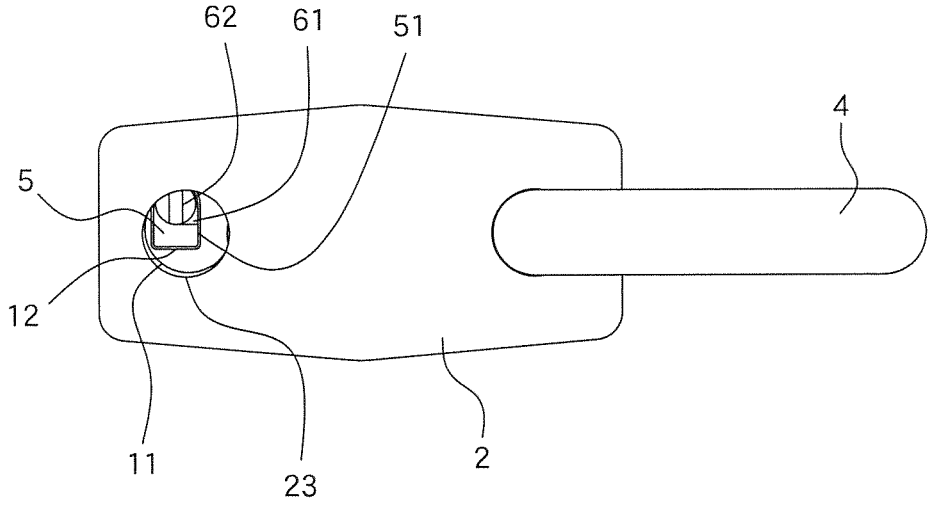
FIG. 7 is a top view when the padlock of the present invention is unlocked.
Figure 8:
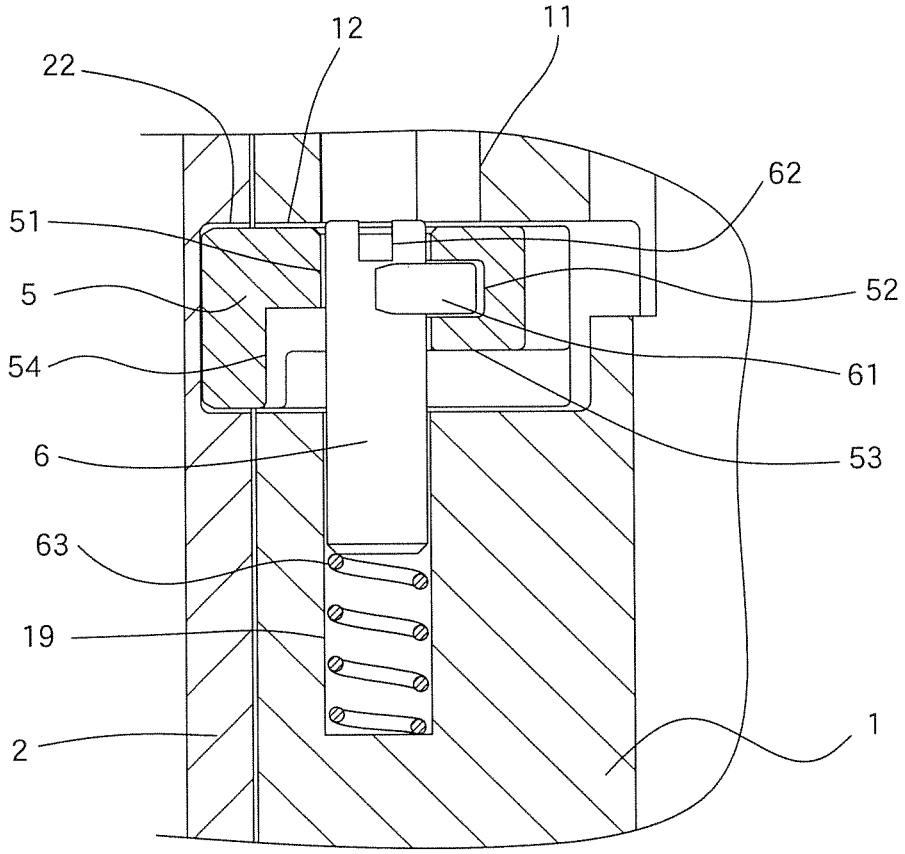
FIG. 8 is an enlarged and cross sectional view of a portion of the padlock of the present invention when the padlock of the present invention is locked.
Figure 9:
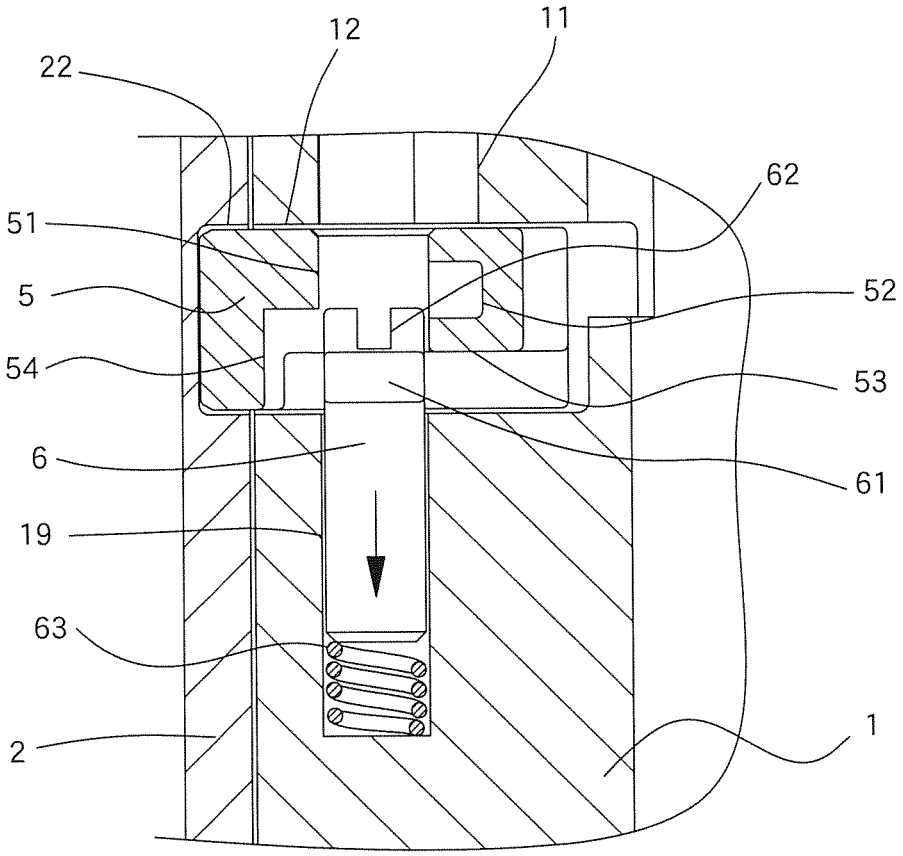
FIG. 9 is an enlarged and cross sectional view to show that the protrusion is moved to the through hole and the positioning member is axially movable.
Figure 10:
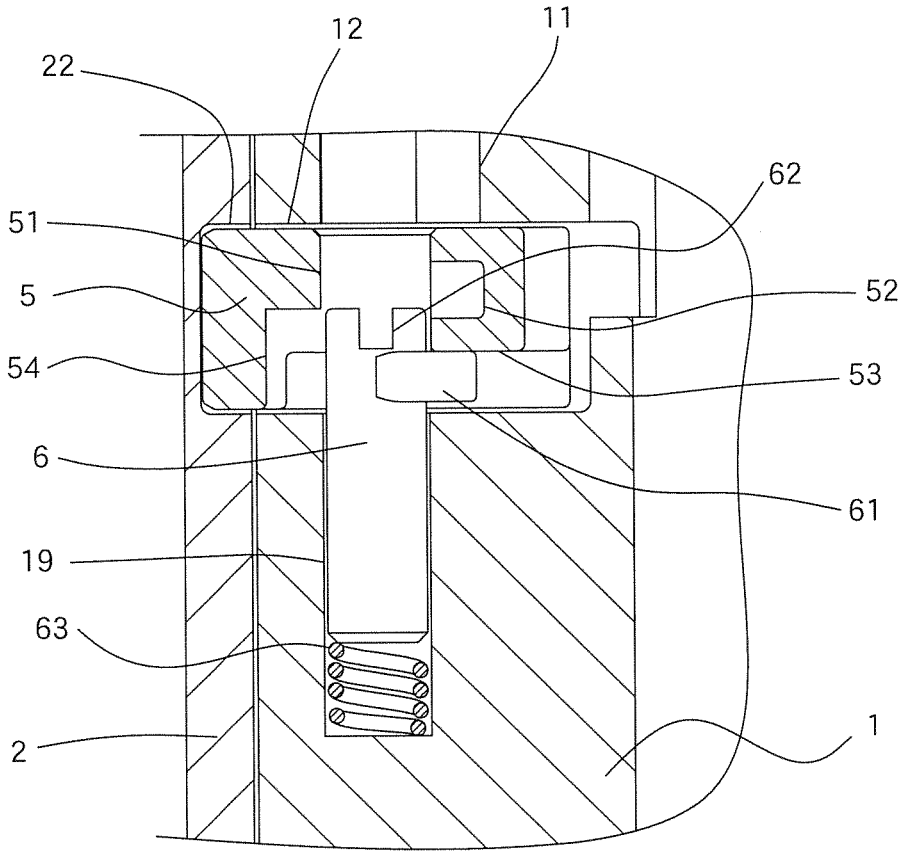
FIG. 10 is an enlarged and cross sectional view to show that the protrusion is moved to the recessed portion.
Figure 11:
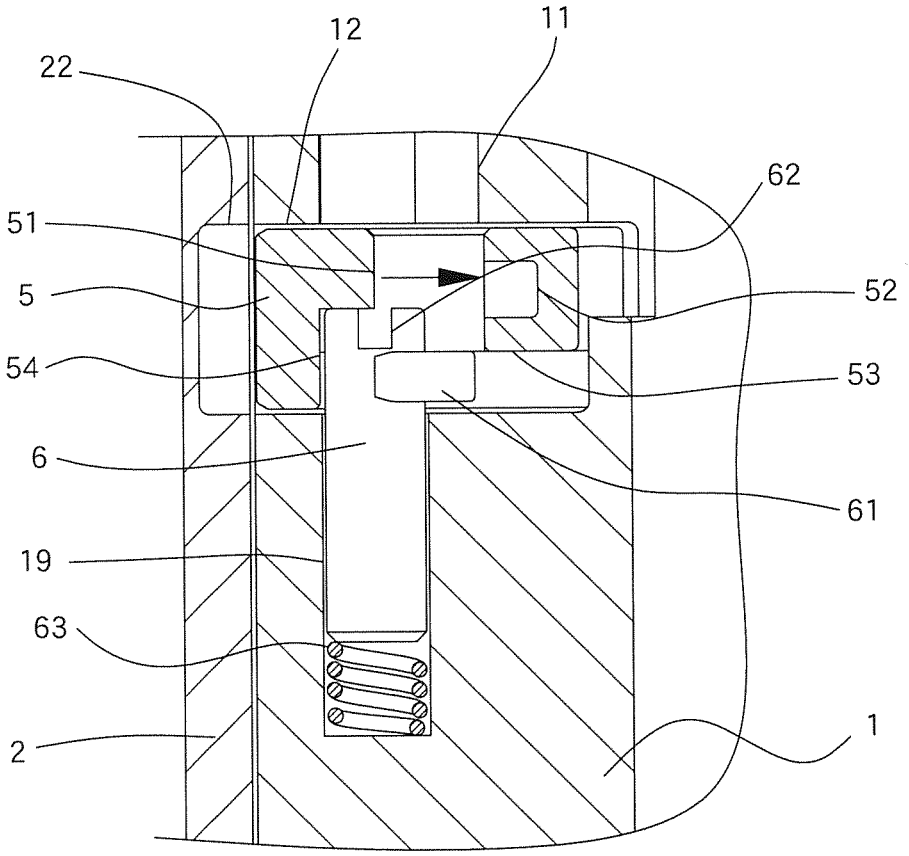
FIG. 11 is an enlarged and cross sectional view of a portion of the padlock of the present invention when the padlock of the present invention is unlocked.

When the slide 5 is to be moved to the unlocked position, the cylinder 3 has to be rotated as mentioned before. The second leg 42 is removed from the first recess 11 as shown in FIGS. 4 and 7, the slide 5 and the positioning member 6 are viewed via the first recess 11. A tool (not shown) is used to rotate the positioning member 6. In one embodiment, in order to easily rotate the positioning member 6, a slot 62 is defined in the top end of the positioning member 6 so that a tool such as a screwdriver is engaged with the slot 62 to rotate the positioning member 6. As shown in FIG. 8, the rotation of the positioning member 6 makes the protrusion 61 remove from the receiving recess 52, as shown in FIG. 9 and move to the through hole 51 so that the positioning member 6 is axially movable. In one embodiment, in order to easily adjust the position of the positioning member 6, the slide slot 12 has a receiving hole 19 communicating with the first recess 11. A resilient member 63 is received in the receiving hole 19 and biased between the inner end of the receiving hole 19 and the lower end of the positioning member 6, wherein the resilient member 63 is compressed. The resilient member 63 pushes the positioning member 6 to position the protrusion 61 at the recessed portion 53, such that the positioning member 6 is rotatable. As shown in FIG. 10, the protrusion 61 is located at the recessed portion 53, the positioning member 6 is disengaged from the through hole 51 and located at the same level as dent 54. Thus, the slide 5 is not restricted by the positioning member 6 and can be moved by the tool as shown in FIG. 11. The slide 5 can be completely retracted into the slide slot 12 and does not protrude beyond the body 1. Therefore, as shown in FIG. 12, the slide 5 can be removed from the housing 2, and the body 1 can also be removed from the housing 2.

Figure 12:
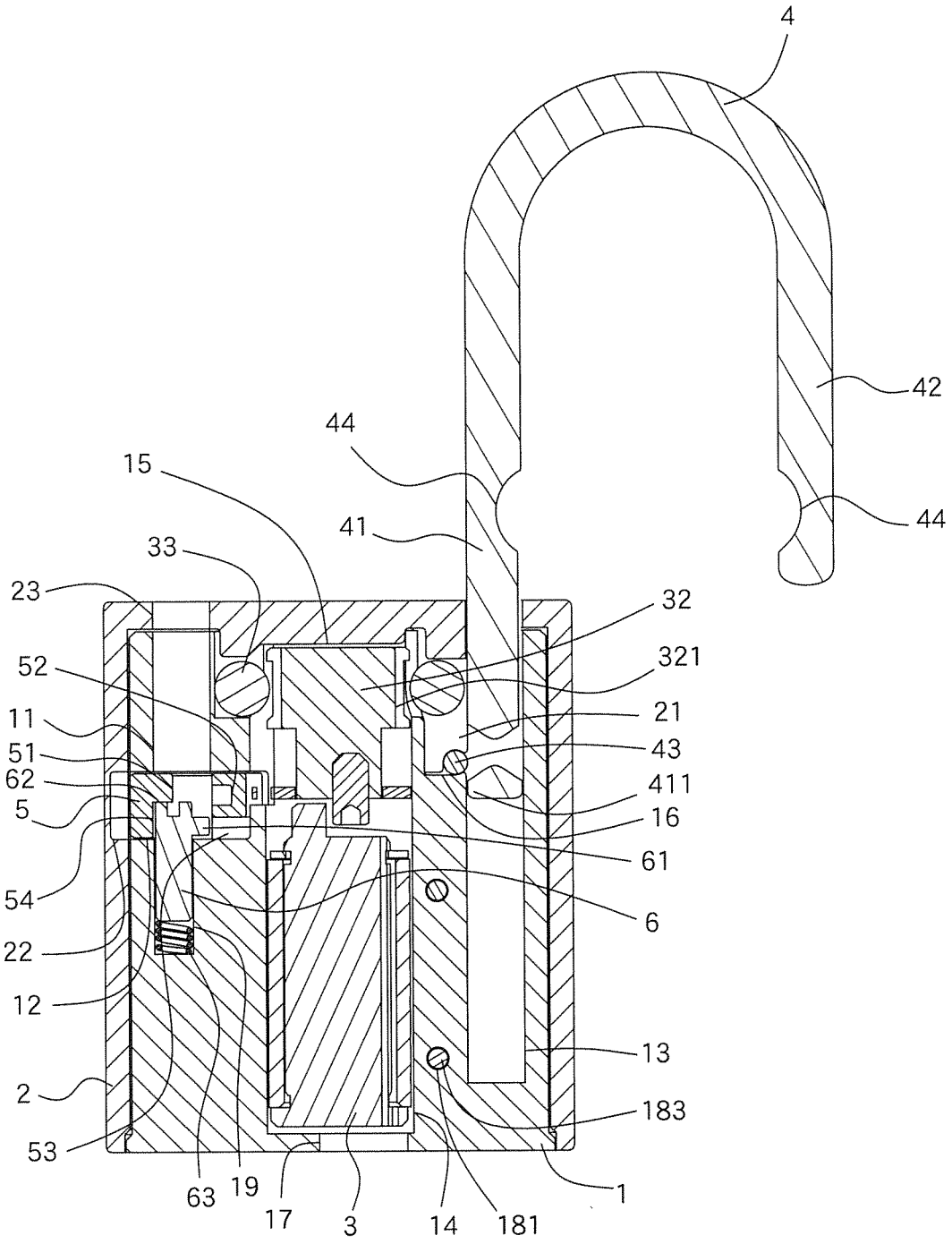
FIG. 12 is a cross sectional view of the padlock of the present invention when the padlock of the present invention is unlocked.

During the removal of the housing 2, as shown in FIGS. 2 and 12, the positioning block 21 is not engaged with the engaging member 43, and the engaging member 43 can be removed from the groove 16 so that the first leg 41 is not restricted by the engaging member 43. Therefore, the housing 2 and the shackle 4 can be removed from the body 1 to replace a new shackle 4. When replacing the cylinder 3, as shown in FIG. 2, by removing the cover 18, the cylinder 3 can be replaced.

When the cylinder 3 or the shackle 4 is replaced, the housing 2 is first mounted to the body 1 and the slide 5 is pushed out from the body 1 and is installed to the first hole 22 as shown in FIG. 10. The positioning member 6 is then rotated to move the protrusion 61 to the through hole 51 as shown in FIG. 9 so that the resilient member 63 pushes the positioning member 6 until the protrusion 61 is located at the receiving recess 52 as shown in FIG. 8. The positioning member 6 is rotated to engage the protrusion 61 with receiving recess 52 to position the slide 5 to finish the assembly of the padlock.

It is noted that only the cylinder 3 is made by metal which is enclosed by the body 1, the cover 18 and the housing 2. The body 1 has the opening 17 to allow the user to insert a key into the keyhole 31 of the cylinder 3. The body 1, the slide 5, the housing 2 and the shackle 4 are made by insulation material so that the user only touch the housing 2, the body 1 and the shackle 4 and can avoid from being shocked by electricity. It is also noted that the body 1, the slide 5, the housing 2 and the shackle 4 can also be made by material other than the insulation material such as metal.

While we have shown and described the embodiment in accordance with the present invention, it should be clear to those skilled in the art that further embodiments may be made without departing from the scope of the present invention.

What is claimed is:

1. A padlock comprising:

a body having a first recess defined in a top thereof, a slide slot defined in one side of the body and communicating with the first recess;

a slide located in the slide slot and being movable between a locked position and an unlocked position, the slide protrudes beyond the body when the slide is located at the locked position, the slide is retracted into the body when the slide is located at the unlocked position, and a housing mounted to the body and having a first hole defined in an inside thereof, two second holes defined in a top of the housing, the slide located in the first hole when the slide is located at the locked position;

wherein the slide has a through hole facing the first recess, a positioning member is engaged with the through hole and positions the slide when the slide is located at the locked position, when the positioning member is removed from the through hole, the slide is released and the slide is movable to the unlocked position.

2. The padlock as claimed in claim 1, wherein the positioning member has a protrusion extending laterally therefrom, a shape of the through hole is correspondent to a shape of the positioning member and a shape of the protrusion, the protrusion is engaged with the slide when the slide is located at the locked position.

3. The padlock as claimed in claim 2, wherein the slide has a receiving recess defined in an outside thereof, when the slide is located at the locked position, the positioning member is rotated and the protrusion is received in the receiving recess.

4. The padlock as claimed in claim 2, wherein the slide has a recessed portion which is located corresponding to a lower end of first recess, the recessed portion communicates with the through hole, a dent is defined in an inside of the recessed portion and located corresponding to the positioning member, when the positioning member is rotated and the protrusion is located in the recessed portion, the slide is movable to the unlocked position.

5. The padlock as claimed in claim 1, wherein the slide slot has a receiving hole communicating with the first recess, a resilient member is received in the receiving hole and biased between an inner end of the receiving hole and a lower end of the positioning member, the resilient member is compressed, a slot is defined in a top end of the positioning member.

6. The padlock as claimed in claim 1, wherein the body, the slide and the housing are made by insulation material.

7. A padlock comprising:

a body having a first recess defined in a top thereof, a slide slot defined in one side of the body and communicating with the first recess;

a slide located in the slide slot and being movable between a locked position and an unlocked position, the slide protrudes beyond the body when the slide is located at the locked position, the slide is retracted into the body when the slide is located at the unlocked position, and a housing mounted to the body and having a first hole defined in an inside thereof, two second holes defined in a top of the housing, the slide located in the first hole when the slide is located at the locked position;

wherein the body has a second recess, a room and a reception hole, the second recess is located at one end of the first recess, a depth of the second recess is deeper than that of the first recess, the reception hole axially communicates with the room and transversely communicates between the first and second recesses, a conjunction portion between the reception hole and the first recess is located above the slide slot, a groove is defined in an inside of the top of the body and communicates with the second recess, an opening is defined in an underside of the body; and wherein the second recess and the room are defined from one side of the body, a cover is connected to the side of the body, the second recess and the room are defined between the body and the cover.

8. The padlock as claimed in claim 7, wherein the body has at least one connection hole, the cover has a passage which is located corresponding to the at least one connection hole, a fixing member extends through passage and the at least one connection hole to fix the cover to the body, a cylinder is received in the room and has a keyhole which is located at the opening, the cylinder drives a cam located in the reception hole, the cam has two recessed areas, two securing members are respectively located at the conjunction portion between the reception hole and the first recess and a conjunction portion between the reception hole and the second recess, the two securing members are received in the two recessed areas when the cam is rotated, a shackle has a first leg and a second leg which is shorter than the first leg, the first leg extends through one of the two second holes and is inserted into the second recess, the first leg has a head at a distal end thereof, the groove has an engaging member located corresponding to the head, the housing has a positioning block to positioning the engaging member, each of the first and second legs has a notch, the second leg extends into the other one of the two second holes and is located in the first recess to impede a conjunction portion between the slide slot and the first recess when the slide is located at the locked position, the cam is rotated to engage the securing members with the notches, when the slide is located at the unlocked position, the second leg is separated from the first recess.

* * * * *